US006146099A

United States Patent [19]

Zipps et al.

[11] Patent Number: 6,146,099

[45] **Date of Patent: *Nov. 14, 2000**

[54] FRANGIBLE FAN BLADE

[75] Inventors: Robert H. Zipps, East Hartford; Reginald H. Spaulding, Hebron; Edward S. Todd, East Hampton; Robert F. Kasprow, Wethersfield; Herman C. Klapproth, Enfield; Douglas A. Welch, Portland; Phyllis L. Kurz, Hebron; Joseph J. Cafasso, Glastonbury, all of Conn.

[73] Assignee: United Technologies Corporation, Hartford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/127,710

[22] Filed: Jul. 30, 1998

Related U.S. Application Data

[62] Division of application No. 08/839,997, Apr. 24, 1997.

[51] Int. Cl.[7] ..... F04D 29/38

[52] U.S. Cl. ..... 416/193 A

[58] Field of Search ..... 416/193 A

[56] References Cited

U.S. PATENT DOCUMENTS

| | | | |
|---|---|---|---|
| 4,714,410 | 12/1987 | Hancock | 416/193 A |
| 4,872,810 | 10/1989 | Brown et al. | 416/193 A |
| 4,917,574 | 4/1990 | Dodd et al. | 416/193 A |
| 5,281,097 | 1/1994 | Wilson et al. | 416/193 A |
| 5,302,085 | 4/1994 | Dietz et al. | 416/193 A |
| 5,573,375 | 11/1996 | Barcza | 416/193 A |
| 5,599,170 | 2/1997 | Marchi et al. | 416/193 A |

*Primary Examiner*—John Kwon

[57] ABSTRACT

A fan in an axial flow gas turbine engine includes a plurality of fan blades. Each fan blade includes an airfoil portion and a root portion with a platform disposed radially therebetween. The platform of each blade extends circumferentially from the blade and is dimensioned to define, with an adjacent platform, an enlarged gap to insure that contact between adjacent platforms is avoided when a blade is released during a blade loss condition. A seal is provided to seal the enlarged gap between adjacent platforms during normal operation of the gas turbine engine.

2 Claims, 4 Drawing Sheets

FRANGIBLE FAN BLADE

This is a division of copending application Ser. No. 08/839,997, filed on Apr. 24, 1997.

TECHNICAL FIELD

The present invention relates to gas turbine engines, and more particularly, to blades for a fan in the engine designed to reduce airfoil fracture during a blade loss condition.

DESCRIPTION OF THE PRIOR ART

A gas turbine engine, such as a turbofan engine for an aircraft, includes a fan section, a compression section, a combustion section, and a turbine section. An axis of the engine is centrally disposed within the engine, and extends longitudinally through these sections. A primary flow path for working medium gases extends axially through the sections of the engine. A secondary flow path for working medium gases extends parallel to and radially outward of the primary flow path.

The fan section includes a rotor assembly and a stator assembly. The rotor assembly of the fan includes a rotor disk and a plurality of outwardly extending rotor blades. Each rotor blade includes an airfoil portion, a dove-tailed root portion, and a platform. The airfoil portion extends through the flow path and interacts with the working medium gases to transfer energy between the rotor blade and working medium gases. The dove-tailed root portion engages the attachment means of the rotor disk. The platform typically extends circumferentially from the rotor blade to a platform of an adjacent rotor blade. The platform is disposed radially between the airfoil portion and the root portion. The stator assembly includes a fan case, which circumscribes the rotor assembly in close proximity to the tips of the rotor blades.

During operation, the fan draws the working medium gases, more particularly air, into the engine. The fan raises the pressure of the air drawn along the secondary flow path, thus producing useful thrust. The air drawn along the primary flow path into the compressor section is compressed. The compressed air is channeled to the combustor section, where fuel is added to the compressed air, and the air-fuel mixture is burned. The products of combustion are discharged to the turbine section. The turbine section extracts work from these products to power the fan and compressor. Any energy from the products of combustion not needed to drive the fan and compressor, contributes to useful thrust.

Federal Aviation Administration (FAA) certification requirements for a bladed turbofan engine specify that the engine demonstrate the ability to survive failure of a single fan blade at a maximum permissible rpm, hereinafter referred to as the "blade loss condition." The certification tests require containment of all blade fragments without catching fire and without following blade loss when operated for at least fifteen minutes. The ideal design criterion is to limit blade loss to a single released blade. Impact loading on the containment casing and unbalanced loads transmitted to the engine structure are then at a minimum. If fan imbalance becomes too great, loss of the entire fan or engine can result.

The certification test method includes releasing a fan blade from the hub by using both mechanical and explosive means. A large diameter hole is drilled through the complete length of the dovetail attachment of a blade to the hub and filled with explosive material. At a predetermined time the explosive material is ignited and burns through the walls of the attachment to release the fan blade. The released blade travels across the blade passage with velocities of several hundred feet per second. Past experience has shown that when prior art fan blades fracture at the outer portion of the dovetail attachment, the platform of the released blade will impact the leading edge of the adjacent blade following the released blade relative to the direction of rotation, hereinafter referred to as "following blade". As a result of the impact, the platform on the released blade may fracture. This fracture will occur at the point of tangency where the platform intersects the fillet radius between the platform and the root portion of the fan blade. A fillet is the radial surface at the intersection of two surfaces. The fractured fragment of the platform exits the engine via the fan duct.

The protruding fractured edge of the platform of the released blade then impacts the leading edge of the following blade and tends to cause the most damage to the following blade. This secondary strike against the following blade may cause the airfoil of the following blade to fracture or sever. Thus, the fan blades of the prior art failed the test acceptance criteria for certification which requires that a fan will not experience following blade loss at a maximum permissible low rotor speed.

There are several possible solutions to the problem of severed fan blades due to the secondary impact of a fractured blade platform. One solution could be to strengthen the airfoil leading edge by adding material to the edge. However, increasing airfoil thickness by adding material to prevent airfoil fracture would have a significant impact on blade weight, fan performance and engine weight and thus be undesirable. Another possible solution would be to structurally reinforce the fan blade platform near the juncture of the platform leading edge and the airfoil portion of the fan blade. This structural reinforcement prevents the fracturing of the released blade platform. However, during a secondary strike, the strengthened platform could result in an even more severe airfoil fracture upon impact on a following fan blade.

SUMMARY OF THE INVENTION

According to the present invention, a fan blade having a platform structured to fracture adjacent the airfoil portion such that the fractured edge of the platform is unable to impact the following fan blade. The risk of damage to the following rotating fan blade is reduced as the edge of the fracture is located circumferentially inward in the root portion of the fan blade. The fan blade structure located circumferentially outwardly of the fracture is blunted to provide for a benign impact on the leading edge surface of the following blade. In addition, the airfoil portion of the fan blade is strengthened by thickening the leading edge.

The fan blade includes several features to prevent airfoil fracture of the following fan blade. A primary feature of the present invention is an undercut which defines a recessed area. The undercut is located in the radially inner surface of the platform and extends into the root portion. In accordance with one particular embodiment of the invention, the undercut has a curved outer surface and a flat chamfered inner surface which is radially inward of the curved outer surface. This undercut moves the fillet radius between the inner surface of the platform and the dovetail neck circumferentially away from the following blade. As a result, when the platform fractures, the edge of the fracture is located within the dovetailed neck in the root portion. No sharp fractured edges protrude to cause damage due to impact with the following blade.

Another feature is that a groove on the outer surface of the platform which is axially and circumferentially coincident with the undercut in the inner surface of the platform. The groove is a weakened area which ensures that the fracture of the platform occurs at the groove. Another feature is a spanwise chamfer located in the leading edge of the root portion. The chamfer provides for a blunted corner, which upon impact on the leading edge of the following blade airfoil will cause minimal damage to the airfoil.

Another feature is the leading edge of the platform is truncated to provide for a blunt corner. The truncation further minimizes damage to the leading edge of the following blade airfoil in the event the leading edge corner of the platform impacts the airfoil. Further, the fan blade airfoil leading edge is thickened at a radial distance from the platform. In one detailed embodiment, the enhanced thickness is defined by a recess in the leading edge at a radially inner location to provide a stronger leading edge.

A primary advantage of the present invention is a durable fan blade. The features of the fan blade minimize the risk of airfoil fracture of a following fan blade when a released blade impacts the following blade. Another advantage is the ease and cost of manufacturing blades with the aforementioned features. Blades of the prior art can be refurbished to include the features discussed which results in blades of the present invention.

The foregoing and other objects, features and advantages of the present invention will become more apparent in the light of the following detailed description of the best mode for carrying out the invention and from the accompanying drawings which illustrate an embodiment of the invention.

BEST MODE FOR CARRYING OUT THE INVENTION

Figure 1:
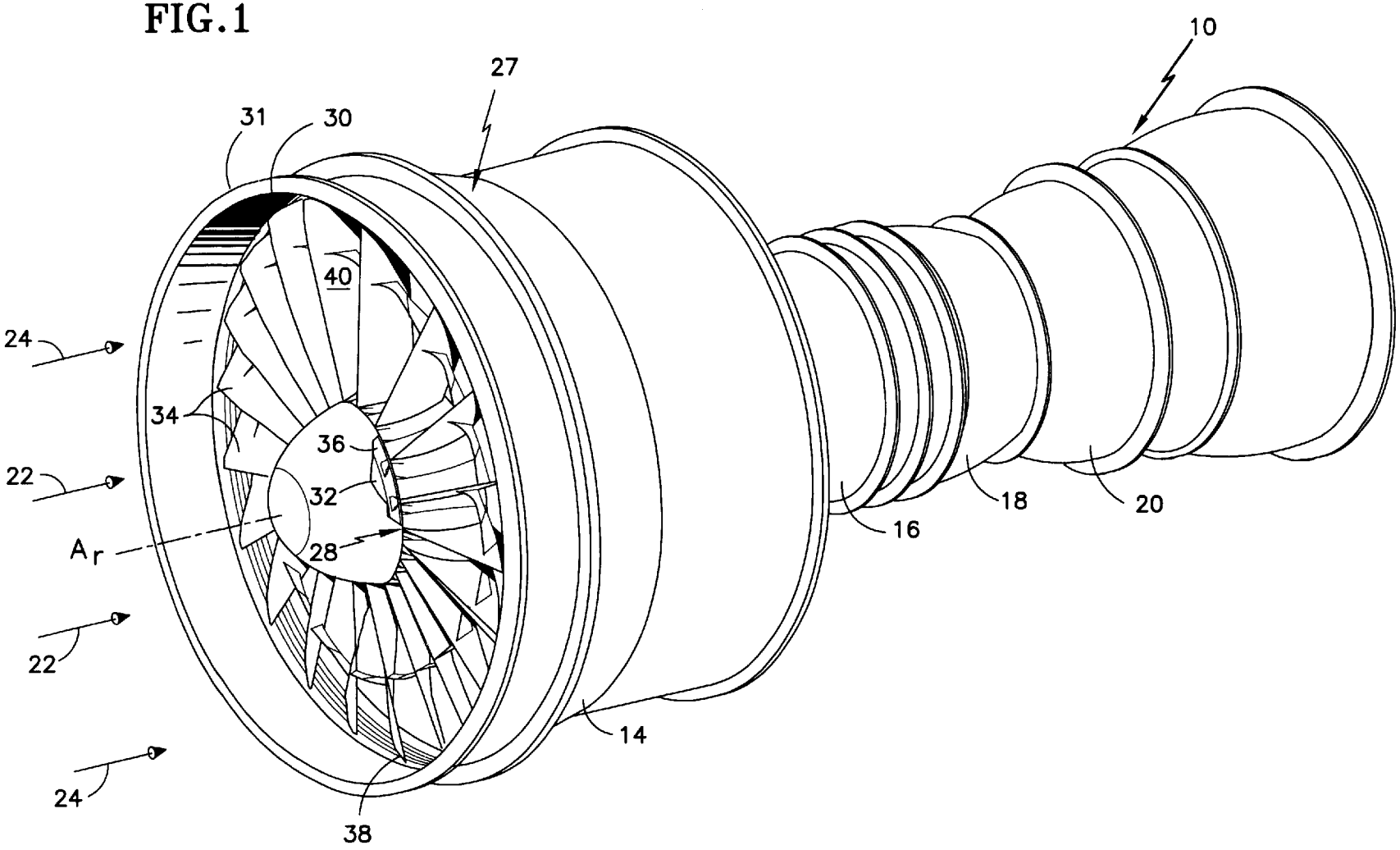
FIG. 1 is a perspective view of an axial flow, turbofan gas turbine engine.

Referring to FIG. 1, an axial flow, turbofan gas turbine engine 10 comprises of a fan section 14, a compressor section 16, a combustor section 18 and a turbine section 20. An axis of the engine $A_r$ is centrally disposed within the engine and extends longitudinally through these sections. A primary flow path 22 for working medium gases extends longitudinally along the axis $A_r$. The secondary flow path 24 for working medium gases extends parallel to and radially outward of the primary flow path 22.

The fan section 14 includes a stator assembly 27 and a rotor assembly 28. The stator assembly has a longitudinally extending fan case 30 which forms the outer wall of the secondary flow path 24. The fan case has an outer surface 31. The rotor assembly 28 includes a rotor disk 32 and a plurality of rotor blades 34. Each rotor blade 34 extends outwardly from the rotor disk 32 across the working medium flow paths 22 and 24 into proximity with the fan case 30. Each rotor blade 34 has a root portion 36, an opposed tip 38, and a midspan portion 40 extending therebetween.

Figure 2:
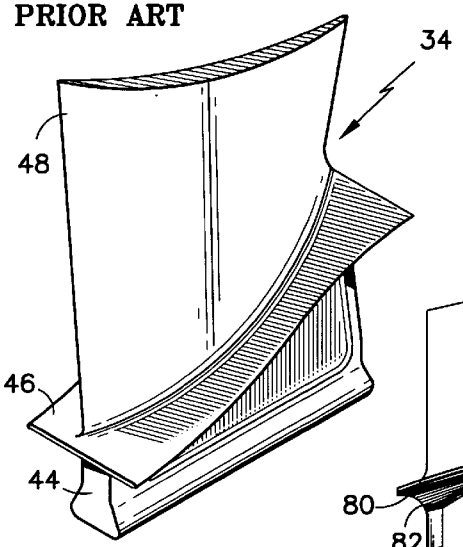
FIG.2 PRIOR ART
FIG. 2 is an isometric view of a blade of the prior art for a fan in the engine of FIG. 1.

FIG. 2 shows a blade of the prior art for a fan in the axial flow gas turbine engine 10 shown in FIG. 1. The fan blade 34 includes a root portion 44, a platform portion 46, and an airfoil portion 48.

Figure 3:
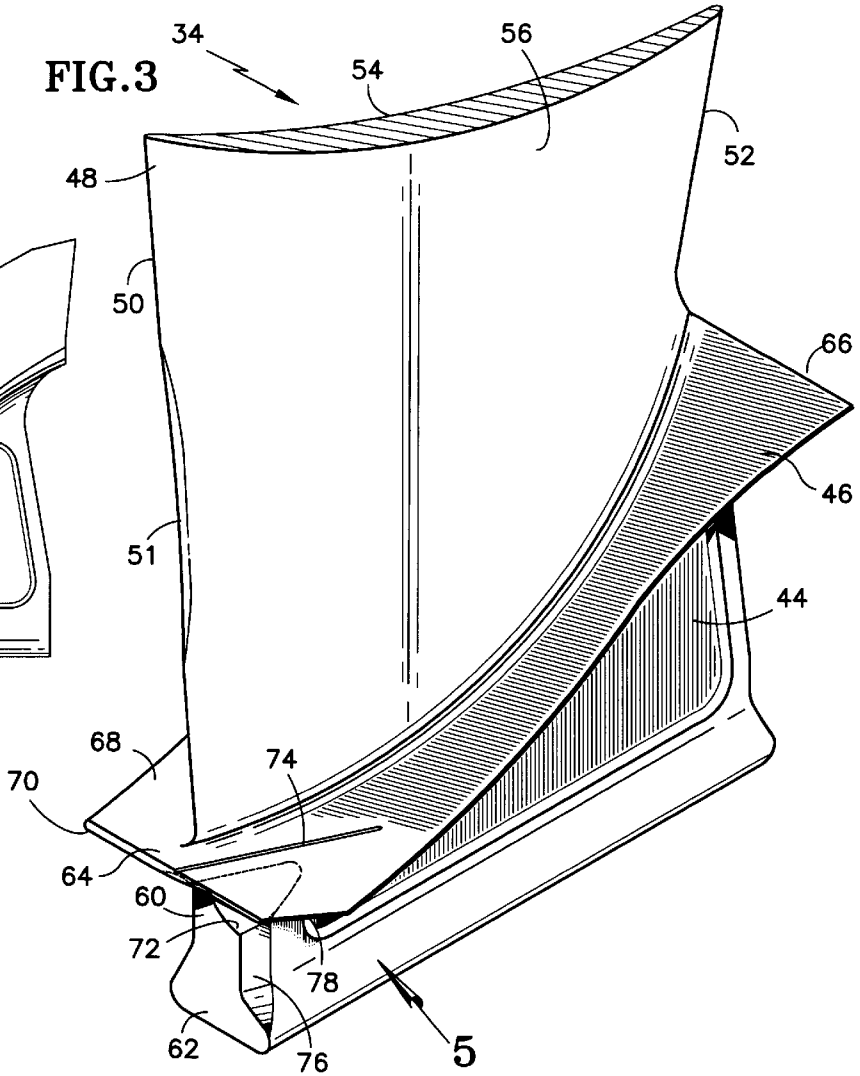
FIG. 3 is an isometric view of a blade of the present invention for a fan in the engine of FIG. 1.

Referring to FIG. 3, the fan blade 34 of the present invention includes a root portion 44, a platform 46 and an airfoil portion 48. The airfoil portion has a leading edge 50, a trailing edge 52, a pressure side 54 and a suction side 56. The airfoil portion is adapted to extend across the flow paths 22, 24 for the working medium gases. The root portion 44 is disposed radially inward of the airfoil portion 48 and it includes a dovetail neck 60 and a dovetail attachment 62. The platform 46 is disposed radially between the airfoil portion 48 and root portion 44. The platform 46 extends circumferentially from the blade. The platform 46 includes a leading edge portion 64 which is forward of the airfoil portion leading edge 50, a trailing edge portion 66 which is aft of the airfoil portion trailing edge 52. The platform 46 also includes an outer surface 68 defining a flow surface of the flow path and an inner surface 70 which is radially inward of the outer surface.

The fan blade 34 of the present invention includes an undercut 72 which defines a recessed area so that when the fan blade fractures the fracture is located within the dovetail neck 60. The undercut 72 is located in the inner surface 70 of the platform and extends into the dovetail neck 60 in the root portion 44. This undercut 72 moves the fillet radius between the inner surface 70 of the platform 46 and the dovetail neck 60 circumferentially away from the following blade. As a result, when the platform 46 fractures, the edge of the fracture is located within the dovetail neck 60 in the root portion 44.

The fan blade 34 of the present invention as illustrated in FIG. 3, also includes a groove 74 on the outer surface 68 of the platform 46 which is axially and circumferentially coincident with the fillet radius between the inner surface 70 of the platform 46 and dovetail neck 60 within the undercut 72. The groove 74 is a weakened area which ensures that the fracture of the platform 46 occurs along the groove 74. In addition, the leading edge of the dovetail neck 60 in the root portion 44 includes a spanwise chamfer 76 which blunts the forward corner of the dovetail neck 60. The chamfer 76 provides for a blunted corner that upon impact on the leading edge of the following blade airfoil 50 will not cause damage to the airfoil 48.

Referring to FIG. 3, the leading edge 64 of the platform is truncated 78 to provide for a blunt corner. The truncation 78 further minimizes the risk of damage to the leading edge 50 of the following blade airfoil 48 in the event the leading edge corner impacts the airfoil 48. In addition, the platform 46 is circumferentially dimensioned to define, with an adjacent platform, a large gap. This gap defines the proximity of adjacent blade platforms. An increased gap reduces the possibility of platform edges of the following adjacent blade contacting those of the released blade during a blade loss condition. The contact between adjacent platform edges causes damage to the platforms 46 which can result in fracturing the following blade platform 46.

Further, the airfoil leading edge 50 is thickened at a radial distance from the platform where the airfoil portion 48 is most likely to be impacted by a disassociated blade. The enhanced thickness is defined by a recess 51 in the leading edge at a radially inner location which provides for a stronger leading edge.

Figure 4:
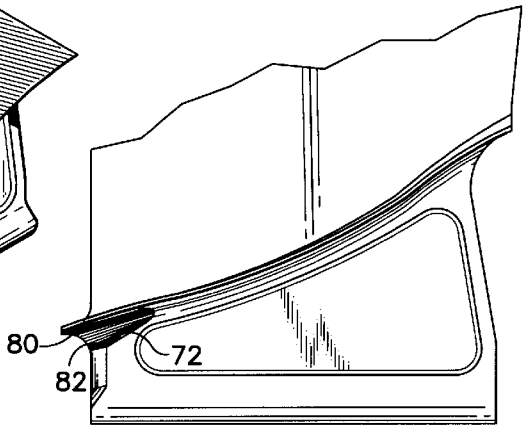
FIG. 4 is a side elevation view of a fan blade of the present invention.

Referring to FIG. 4, the undercut 72 extends into the dovetail neck 60 of the root portion 44. The undercut 72 includes a curved outer surface 80 and a flat chamfered inner surface 82 radially inward of the curved outer surface 80. This undercut 72 moves the fillet radius between the inner surface 70 of the platform 46 and the dovetail neck 60 circumferentially away from the following blade. As a result, when the platform 46 fractures, the edge of the fracture is located within the dovetail neck 60 in the root portion 44.

Figure 5:
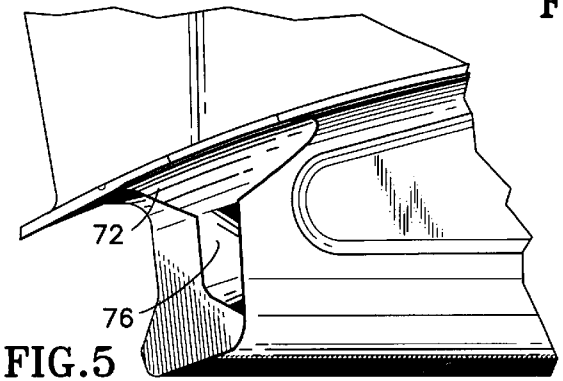
FIG. 5 is an enlarged isometric view of the root portion of the fan blade of the present invention shown in FIG. 3.

FIG. 5 is an enlarged isometric view of a fan blade 34 of the present invention. It further shows the undercut 72 in the inner surface 70 of the platform 46 extending into the dovetail neck 60. In addition, it shows the spanwise chamfered forward corner 76 of the dovetail neck 60.

Figure 6:
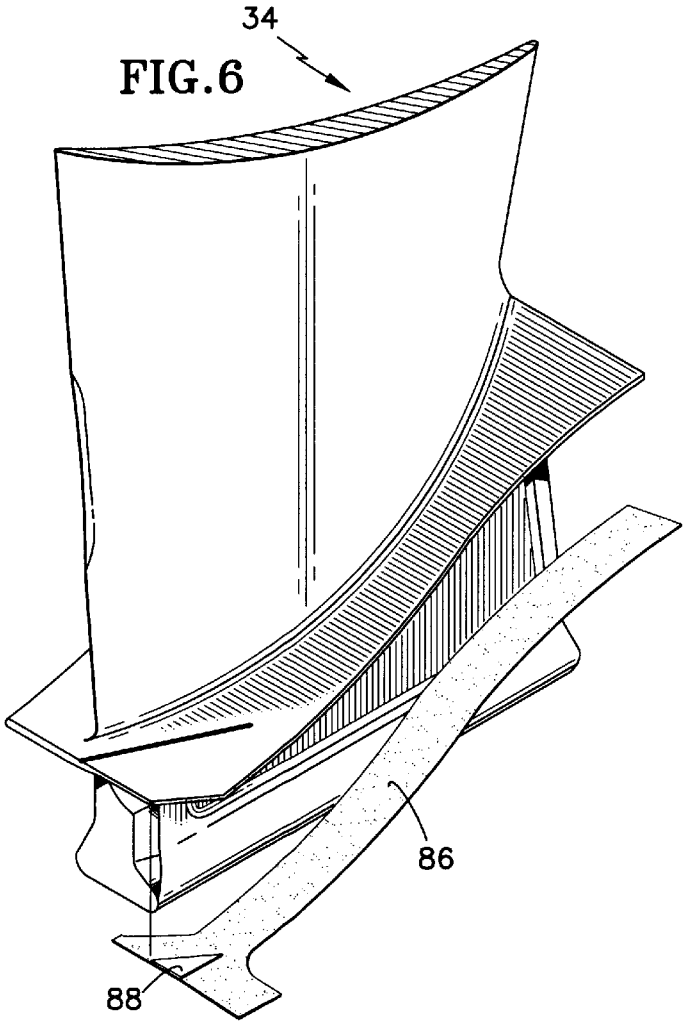
FIG. 6 is an isometric view showing the fan blade with an associated seal.
Figure 8:
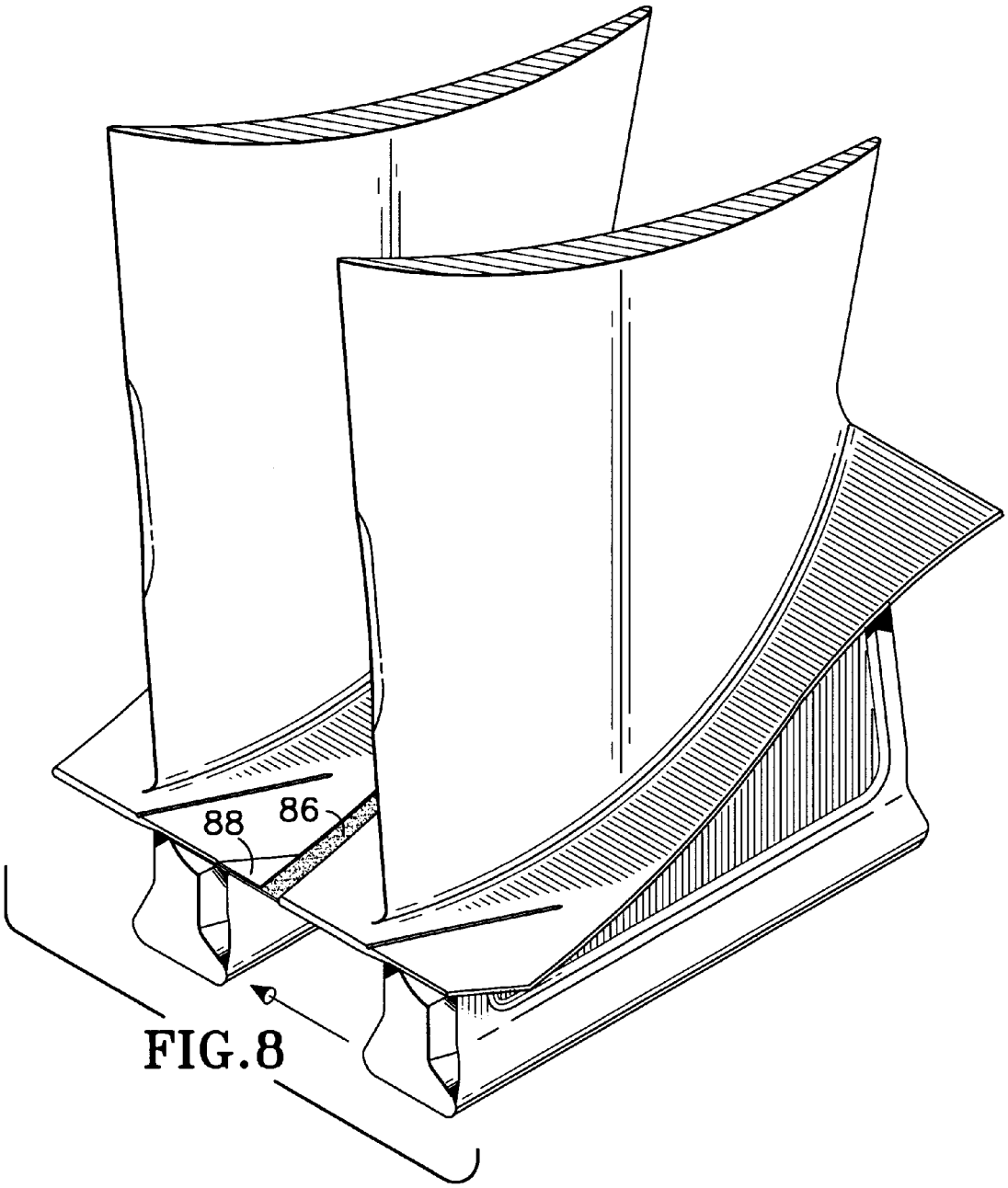
FIG. 8 is an isometric view of two adjacent fan blades with an oversized gap therebetween being sealed with the seal of FIG. 6.

FIG. 6 illustrates a seal 86 associated with the fan blade 34 of the present invention. The seal 86 is generally elastomeric. The seal is adapted to seal the locally large gap between platforms 46 of adjacent blades 34. The seal 86 includes an upstanding or raised portion 88 which is adapted to seal the locally large gap defined by the truncation 78 in the leading edge 64 of the platform 46.

Figure 7:
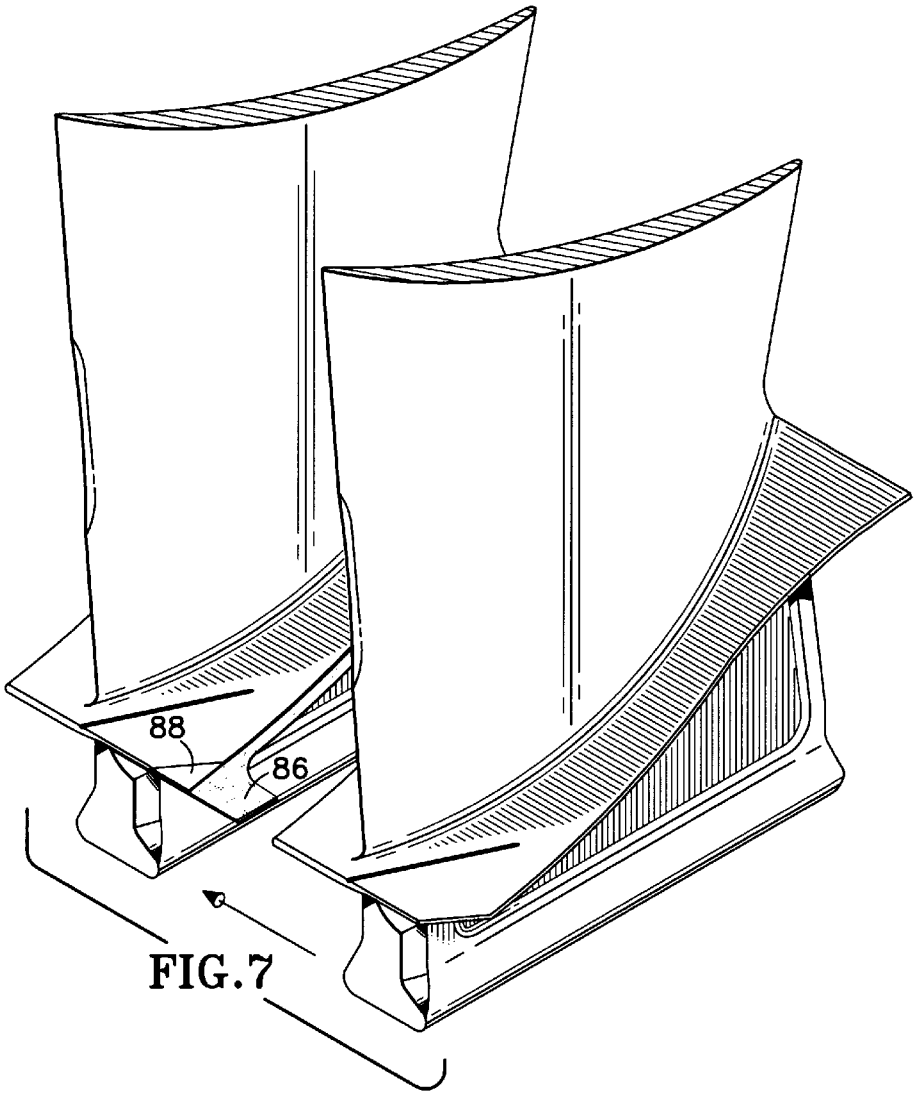
FIG. 7 is an isometric view of the seal being adapted between two adjacent fan blades.

Referring to FIG. 7, the seal 86 is disposed between two adjacent platforms 46. The seal 86 is adapted to seal the gap in the platform to platform interface. The elastomeric seal 86 is fixed to the inner surface 70 of one platform 46 and is centrifugally urged into engagement with the inner surface 70 of an adjacent platform 46.

During operation of the gas turbine engine, the working medium gases are compressed in the fan section 14 and the compressor section 16. The gases are burned with fuel in the combustion section 18 to add energy to the gases. The hot, high pressure gases are expanded through the turbine section 20 to produce thrust and therefore useful work. The work done by expanding gases drives rotor assemblies in the engine, such as the rotor assembly 28 extending to the fan section 14 across the axis of rotation $A_r$.

Due to loss of structural integrity at the dovetailed attachment 62 of the fan blades 34 to the hub 32, a blade loss condition may occur. This scenario is tested for as part of FAA certification requirements. The released blade travels across the fan blade passage with velocities of several hundred feet per second.

The platform 46 of the released blade impacts the leading edge of the airfoil 50 of the following adjacent blade. The airfoil leading edge 50 of the fan blades are thickened and therefore strengthened. The thickness is achieved by recessing 51 the leading edge at a radially inner location. As a result, damage to the airfoil leading edge 50 will be reduced. In addition, the truncated 78 leading edge of the platform provides for a blunt strike with the airfoil leading edge 50. This feature further provides for reduced airfoil damage.

The primary impact of the released blade platform 46 on the airfoil 48 of the following blade will cause the platform 46 of the released blade to fracture along the groove 74 on the outer surface 68 of the platform 46 as this groove 74 defines a weakened area. The edge of fracture will then be located in the recessed undercut 72 area which is circumferentially inward of the root portion 44. The fillet radius between the inner surface 70 of the platform and the dovetail neck 60 within the undercut 72 and groove 74 define the location of the platform fracture. By locating the edge of the fracture in the undercut 72, the edge of the fracture is located in the dovetail neck 60 of the root portion 44. As a result, no sharp fractured edges protrude and impact the following fan blade. Thus, secondary strikes of the fractured platform edge are less likely. Any secondary strikes of the released blade will be benign as the areas that will impact are blunted such as the spanwise chamfer 76 on the dovetail neck 60.

Thus, the risk of following blade airfoil fracture is minimized. Further, following blade platform damage is reduced as the interplatform gaps between adjacent blades is increased. This allows for reducing inadvertent contact with the released blade platforms. In the preferred embodiment, the interplatform gap was increased up to 0.090 inches. This dimension represents a fifty percent (50%) increase in interplatform gap over the prior art. In addition, for the gap defined by the truncation of the platform leading edge, the interplatform gap in this localized area was increased up to 0.50 inches.

It should be noted that the disassociated fragments of the fractured platform along with the released blade impact the fan containment case as they travel across the fan passage. The containment case fractures the released blade into fragments which become entrapped within the engine, or which leave the engine via the fan duct.

A primary advantage of the present invention is the durability of fan blades of the present invention. The features of the fan blade prevents airfoil fracture of a following fan blade when a released blade impacts the following blade. Another advantage is the ease and cost of manufacturing blades with the aforementioned features. Blades of the prior art can be refurbished to include the features discussed which results in blades of the present invention.

Although the invention has been shown and described with respect to detailed embodiments thereof, it should be understood by those skilled in the art that various changes in form and detail thereof may be made without departing from the spirit and the scope of the claimed invention.

What is claimed is:

1. An improved fan in an axial flow gas turbine engine disposed about an axis, the gas turbine engine including an axially directed flow path defining a passage for working medium gases, the fan including a plurality of fan blades with each of said plurality of fan blades having an airfoil portion having a leading edge, a trailing edge, a pressure side and a suction side and adapted to extend across the flow path for working medium gases: a root portion disposed radially inward of the airfoil portion, the root portion including a leading edge, a trailing edge, a dovetail neck and a dovetail attachment; and a platform disposed radially between the airfoil portion and the root portion, the platform extending circumferentially from the blade and including a leading edge portion forward of the airfoil portion leading edge, a trailing edge portion aft of the airfoil portion trailing edge, an outer surface defining a flow surface of the flow path, and an inner surface radially inward of the outer surface, wherein the improvement comprises:

said platform being circumferentially dimensioned to define, with an adjacent platform, an oversized gap that is sufficient enough such that contact is avoided between adjacent platforms during a blade loss event.

2. A fan blade according to claim 1, which further includes an elastomeric seal attached to the inner surface of the platform to seal with an adjacent platform, the seal is adapted to seal the oversized gap in the platform to platform interface, and the elastomeric seal is centrifugally urged into engagement with the radially inner surfaces of an adjacent platform.

* * * * *